US006345628B2

(12) United States Patent
Petit

(10) Patent No.: US 6,345,628 B2
(45) Date of Patent: Feb. 12, 2002

(54) ENHANCED TIGHTNESS COMPACTS FOR COSMETICS

(75) Inventor: Robert Petit, Chevilly-Larue (FR)

(73) Assignee: LIR France, Chevill-Larue (FR)

( * ) Notice: Subject to any disclaimer, the term of this patent is extended or adjusted under 35 U.S.C. 154(b) by 0 days.

(21) Appl. No.: 09/765,362

(22) Filed: Jan. 22, 2001

(30) Foreign Application Priority Data

Jan. 20, 2000 (FR) ..... 00 00723

(51) Int. Cl.[7] ..... A45D 42/02; A45D 33/22; A45D 33/24

(52) U.S. Cl. ..... 132/304; 132/295; 132/294

(58) Field of Search ..... 132/304, 295, 132/315, 294, 296, 297, 300; 206/581, 235; 220/504

(56) References Cited

U.S. PATENT DOCUMENTS

| | | | | | |
|---|---|---|---|---|---|
| 1,828,652 | A | * | 10/1931 | Friedberg | 132/295 |
| 4,586,519 | A | | 5/1986 | Seidler et al. | |
| 5,325,961 | A | * | 7/1994 | Ford et al. | 206/229 |
| 5,431,176 | A | * | 7/1995 | Favre | 132/295 |
| 5,568,820 | A | * | 10/1996 | Dirksing | 132/315 |
| 5,884,636 | A | * | 3/1999 | Sheffler et al. | 132/295 |
| 5,896,866 | A | | 4/1999 | Quennssen | |
| 5,909,738 | A | | 6/1999 | Quennssen | |
| 5,950,639 | A | * | 9/1999 | Suzuki et al. | 132/294 |

FOREIGN PATENT DOCUMENTS

| | | |
|---|---|---|
| FR | 2 576 496 | 1/1986 |
| FR | 2 744 099 | 1/1996 |
| FR | 2 765 462 | 1/1999 |
| JP | 09-037839 | 2/1997 |
| WO | WO 87/07483 | 12/1987 |

* cited by examiner

*Primary Examiner*—John J. Wilson
*Assistant Examiner*—Robyn Kieu Doan
(74) *Attorney, Agent, or Firm*—Connolly Bove Lodge & Hutz LLP

(57) ABSTRACT

The compact (1) comprises a lid (2), a hollow base (3) typically comprising, using an intermediate grid (4), a recipient (5), a hinge (7) and a clasp (8), "upper" sealing means attached to said lid and "lower" sealing means attached to said base, said sealing means co-operating when said compact is closed, and is characterised in that:

a) each of the "upper" and "lower" sealing means comprises a typically vertical skirt, referred to as "upper" (20) or "lower" (40) respectively, b) said tight co-operation is a tangential connection of said "upper" (20) and "lower" (40) skirts, with an angle $\alpha$ between 45° and 90°, c) at least one of said "upper" or "lower" skirts is a flexible skirt (8, 28, 48), d) masking means (21, 41), typically rigid and attached to said compact, surround at least one of said skirts.

21 Claims, 4 Drawing Sheets

ENHANCED TIGHTNESS COMPACTS FOR COSMETICS

FIELD OF THE INVENTION

This invention relates to the field of compacts intended to contain cosmetics or beauty products, typically makeup powder.

BACKGROUND OF THE INVENTION

As a general rule, compacts typically comprise:

a hollow lid fitted with an inner mirror, a hollow base, typically equipped with a grid or intermediate support of at least one recipient intended to receive said cosmetic, a hinge, forming the connection between said lid and said base, enabling the articulation of said lid and the opening of said compact, a clasp or any locking and unlocking means of said lid in relation to said base, so as to ensure the opening and closing of said compact, a clasp typically comprising a push button.

Numerous embodiments of compacts are known, which may relate to one or more components of the compact.

In this way, in relation of the patents in the applicant's name, it is possible to mention:

patent FR 2 661 080 which describes a small class makeup compact, patent FR 2 701 365 which describes a convertible makeup compact, patent FR 2 725 958 which relates an assisted opening joined closure compact, patent FR 2 737 192 which describes a pivoting lid compact equipped with a flexible tabbed hinge, patent FR 2 755 352 which describes a compact with assisted opening, patent FR 2 755 353 which describes a compact with an unlocking and pre-opening push button, patent FR 2 756 155 which describes a makeup compact comprising a base, an intermediate plate and a lid fitted with an inner mirror.

In addition, the French application No. 2 761 243 relating to a tight closure compact for cosmetics is known.

The compacts according to the state of the art are typically suitable to be filled with powders in a form which is relatively inert and stable over time.

However, increasingly, manufacturers are offering powders with a more complex formulation, which may, for this reason, comprise a volatile product.

Therefore, it has become essential to be able to manufacture tight compacts, i.e. compacts which, once closed, lose little or no volatile product, at least over a period which is at least equivalent to the average service life of said compacts.

Moreover, the tightness must be obtained without modifying the appearance of the compact significantly, particularly once open.

In addition, the means introduced to seal the compacts must not generate a marked additional cost, with reference to standard compacts, meaning that said means must be inherently simple and that the manufacture of the different parts, their assembly and assembly rates and the materials forming these different parts, must be approximately those already used in the art.

Finally, in the field of compacts in particular, product range renewal is continuously required, as is product personalisation.

DESCRIPTION OF THE INVENTION

According to the invention, the compact intended to be filled with cosmetics comprises a lid, generally fitted with a mirror, a hollow base typically comprising, possibly using an intermediate grid attached to said base, a recipient intended to receive said cosmetics, a hinge and a clasp, comprises "upper" sealing means attached to said lid and "lower" sealing means attached to said base or, if applicable, to said grid or said recipient, said sealing means co-operating when said compact is closed, and is characterised in that:

a) each of the "upper" and "lower" sealing means comprise a typically vertical skirt, referred to as "upper" and "lower" respectively, b) said tight co-operation is a tangential connection of said "upper" and "lower" skirts, with an angle $\alpha$ between 45° and 90°, c) at least one of said "upper" or "lower" skirts is a flexible skirt and shows an elasticity or reversible deformability under stress, such that said tangential connection induces said deformation of at least said flexible skirt by reaction along a direction typically perpendicular to the angle $\alpha$, d) masking means, typically rigid and attached to said compact, border, and possibly surround, at least one of said skirts, and typically said flexible skirt, over all or part of its height, at a distance from said skirt enabling all or part of said reversible deformation of said flexible skirt, so as to obtain a tight compact with sealing means, which firstly are completely or partially masked and secondly enable great freedom in terms of relative axial positioning and, as a result, standard precision for the parts forming said compact.

This combination of means solves the problems described. Indeed, the applicant has observed that a tight co-operation could be obtained with only one tangential connection of a relatively high slope of an angle $\alpha$ at least equal to 45°, and preferentially greater than 75°, such that said "upper" and "lower" skirts co-operate by sliding on each other with deflection of said flexible skirt to the position corresponding to the closed lid, where the deflection stress may remain constant during the closure of the lid when the angle $\alpha$ is around 90°, or increase slightly for a smaller angle $\alpha$.

Preferentially, the materials selected to implement this tight co-operation are plastics which show, in addition to sufficient resilience, a sufficiently smooth surface condition such that the friction coefficient is low and a sufficient surface hardness such that there is no premature wear of the sealing means due to friction of said upper and lower skirts; the hardness or rigidity of the materials should not be too high either so as not to create sealing problems.

According to the invention, said tangential connection must preferentially form a strip, which is closed on itself, but narrow in width, typically less than 3 mm wide, and preferentially less than 1 mm wide, such that the deflection stress created by said tight co-operation creates a local pressure which increases as the width of the strip decreases, and thus, ensure the tightness, possibly using localised plastic flow in the event of a very high local concentration of deflection stress, due to irregular dimensions.

In this way, contrary to expectations, the means of the invention, although they are simple, are sufficient to obtain the required tightness.

According to a theory suggested by the applicant, this may be due to the actual design of said tight cooperation according to the invention, and particularly due to the fact that the upper and lower skirts never come to a stop against any surfaces, the ends being free in terms of axial movement. However, if the end of a flexible skirt came to a stop and was blocked, it can be assumed that a compression stress would appear in the skirt, which would probably affect the deflection stress and reduce its effectiveness.

In addition, in practical terms, the fact that a deflection stress is sufficient to ensure tightness means that it is possible to have, for the parts forming the sealing means, a manufacturing precision, typically by moulding, which is the same as that for standard parts, which represents a major advantage of the invention. Indeed, tightness is obtained by the existence of a tangential deflection stress over the entire skirt perimeter, and which is applied over a relatively large axial distance, typically of several mm, which therefore allows the system a degree of freedom in the axial direction.

DESCRIPTION OF FIGURES

All the figures relate to the invention and are vertical sections (except FIG. 13*b* which is a partial view from below, and FIGS. 15*b* and 16*b* which are partial horizontal views), where the compact is assumed to be placed on a flat surface, and are partial sections (except FIGS. 1 and 12 which are full sections), intended to illustrate the co-operation of the upper skirt 20 and lower skirt 40 resulting in the tightness according to the invention.

Figure 1:
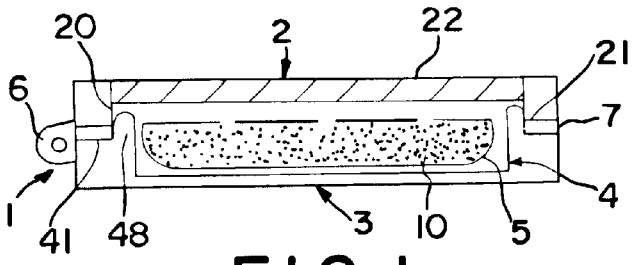
FIG. 1 is a section perpendicular to the hinge 6 of the compact 1. This compact comprises, in addition to a hinge 6 and a clasp 7.

- a lid 2 fitted with a mirror 22, and a sealing skirt 20—forming the upper sealing means—the perimeter of which is bordered by a punched insert forming upper masking means 21,
- a base 3 comprising a grid 4 wherein a removable recipient 5 containing the cosmetic 10 is placed. This grid comprises a lower flexible skirt 48 in the form of an inverted "U" 482—forming the sealing means and is surrounded by an insert 41 forming lower masking means 41.

Figure 1A:
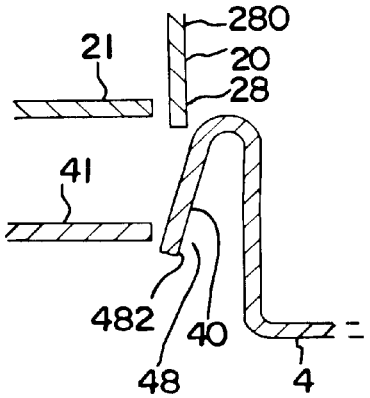

FIG. 1*a* illustrates the position of the upper skirt 20 and lower skirt 40 just before said tight co-operation, flexible skirts 28, 48 surrounded externally by the upper 21 and lower 41 masking means, respectively. The upper skirt 20 is a single flexible surface 280, while the lower skirt 40 is an inverted "U" or "V" shaped skirt 482.

Figure 1B:
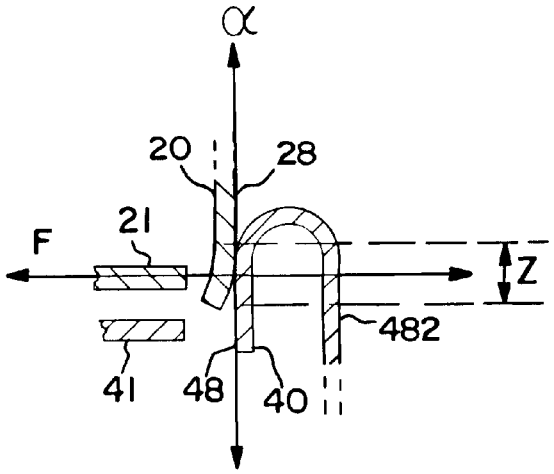

FIG. 1*b* illustrates the position of the upper skirt 20 and lower skirt 40 and flexible skirts 28, 48 forming said tight co-operation, with the direction $\alpha$ of the tangential connection, of around 90°, with the direction F, perpendicular to the above direction, deflection stress applied between the two skirts, and the axial distance Z along which said tight co-operation is retained.

Figure 1C:
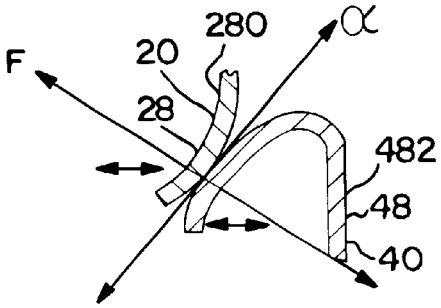

FIG. 1*c* represents an alternative of FIG. 1*c* wherein the direction $\alpha$ of the tangential connection is around 60°.

Figure 2A:
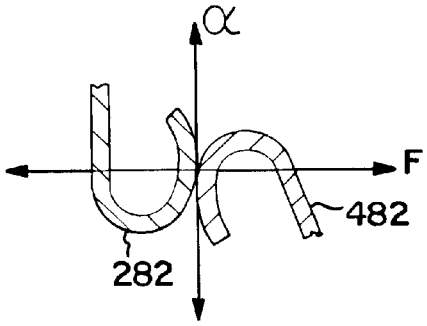
Figure 2:
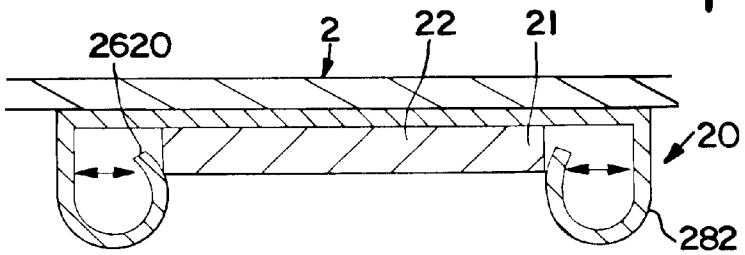

FIG. 2 illustrates an embodiment of the upper skirt 20, an inverted "U" shaped skirt 282, wherein the mirror is also used as the upper masking means 21.

FIG. 2*a* illustrates the co-operation of the two skirts, upper 20 and lower 40, both skirts 282, 482 having an inverted "U" shape.

Figure 3:
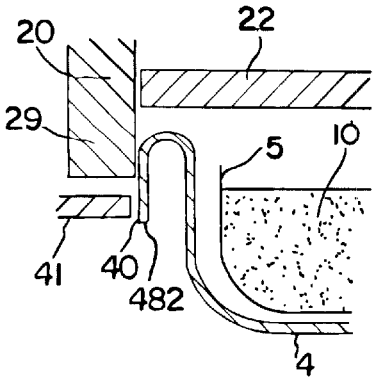

FIG. 3 illustrates an embodiment wherein the upper skirt 20 is a rigid skirt 29, the lower skirt 48, 482 being similar to the lower skirt in the previous figures.

Figure 4A:
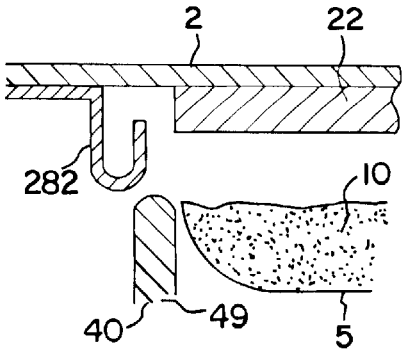
Figure 4B:
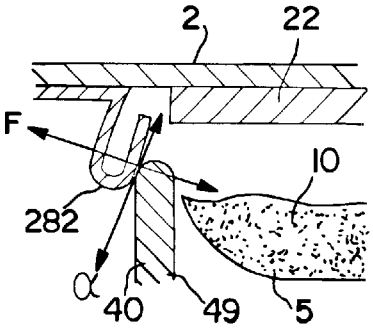

FIGS. 4*a* and 4*b*, similar to FIGS. 1*a* and 1*b*, illustrate another embodiment wherein the upper skirt is that in FIG. 2, the lower skirt 40 being a rigid skirt 49.

Figure 5:
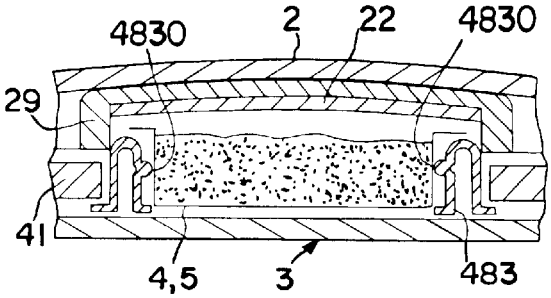
Figure 5A:
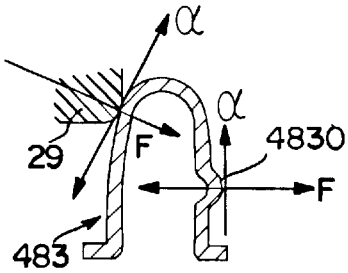

FIGS. 5 and 5*a* illustrate a particular embodiment of the invention wherein tightness is obtained with a flexible section 483 forming two tangential connections, one with the rigid upper skirt 29, the other with the grid 4 or the recipient 5. In the latter case, the section 483 may comprise ribbing 4830 providing contact with the grid 4 or the recipient 5.

Figure 6A:
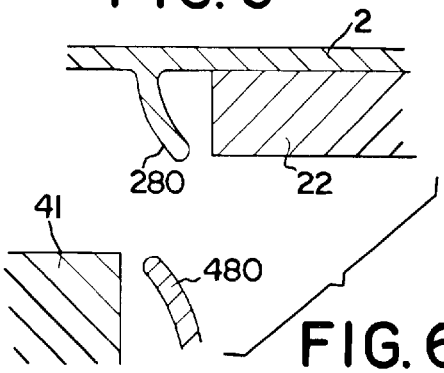
Figure 6B:
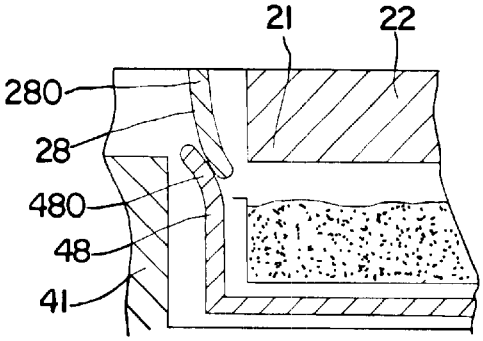

FIGS. 6*a* and 6*b*, similar to FIGS. 4*a* and 4*b*, illustrate the case in which the upper and lower skirts are flexible 28, 48 and are flexible-surface skirts 280, 480, the upper skirt 280 using the mirror 22 as upper masking means 21, and the lower skirt using a punched insert 41 as lower masking means.

Figure 7:
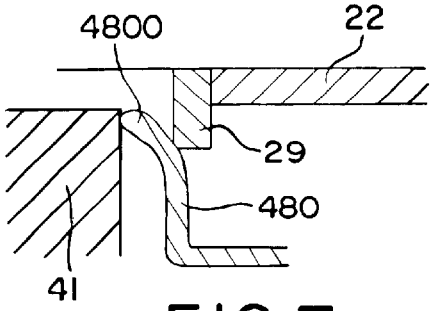
Figure 7A:
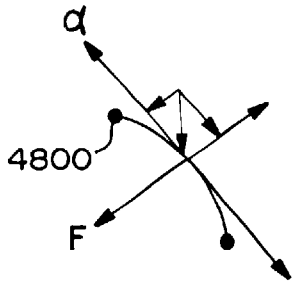

FIGS. 7 and 7*a* illustrate another embodiment, similar to FIG. 6*b* in relation to the lower skirt 480, but where the end 4800 of the lower skirt is resting against the lower masking means 41, wherein the upper skirt is a rigid skirt 29, FIG. 7*a* illustrating said tangential connection.

Figure 8:
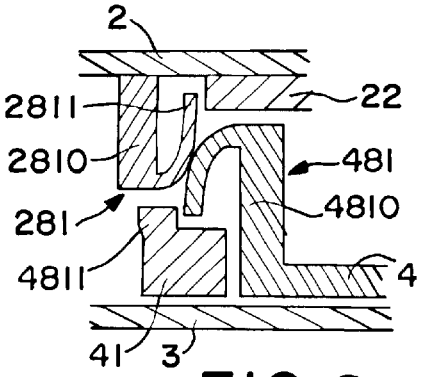

FIG. 8 illustrates another skirt embodiment 281, 481, each skirt comprising a rigid part 2810, 4810 and a flexible part 2811, 4811 ensuring tightness.

Figure 9A:
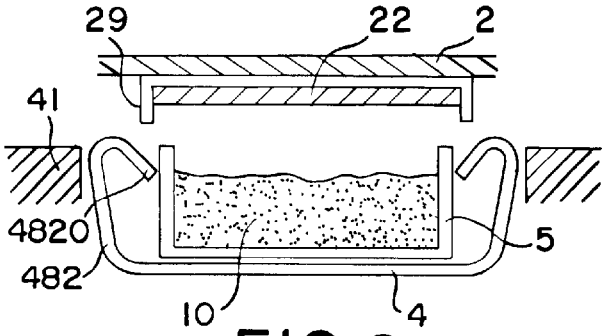
Figure 9B:
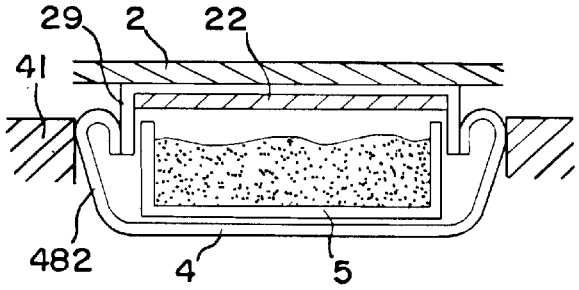

FIGS. 9*a* and 9*b*, similar to FIGS. 6*a* and 6*b*, illustrate another embodiment wherein the upper skirt 29 is rigid—or possibly flexible if the recipient 5 is rigid, wherein the lower skirt 484 is inserted and held in said lower masking means 41, and wherein tightness is obtained by the tangential connection between the upper skirt 29 and the free end 4820 of the lower skirt 482.

Figure 10:
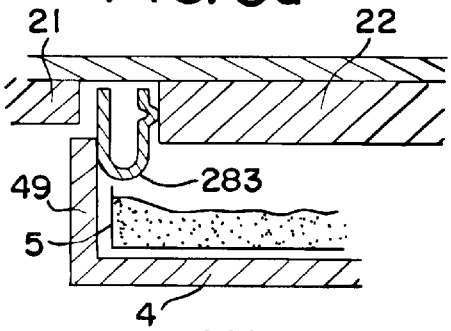
Figure 11:
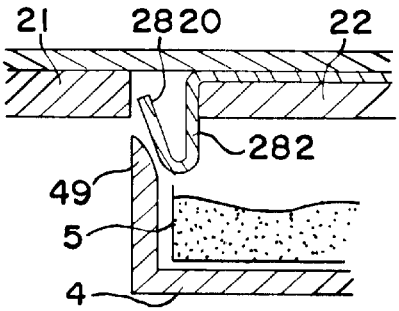

FIGS. 10 and 11 illustrate similar embodiments wherein the lower skirt 49 is rigid, the flexible upper skirt being comprised between the mirror 22 and an insert 21 used as the upper masking means. In FIG. 10, the upper skirt 282 has a "U" or "V" profile, the end 2820 of which is masked by the masking means 21, while in FIG. 11, the upper skirt is a skirt 283 shaped like a section similar to the section 483 in FIGS. 5 and 5*a*.

Figure 12:
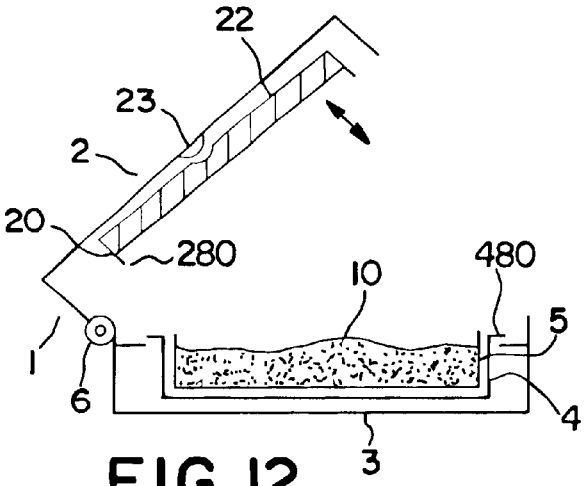

FIG. 12 illustrates the case where the upper skirt encloses the mirror 22 and may be oriented with a rotation axis 23, parallel with the hinge, so as to facilitate the tight operation of the lips 280, 480.

Figure 13A:
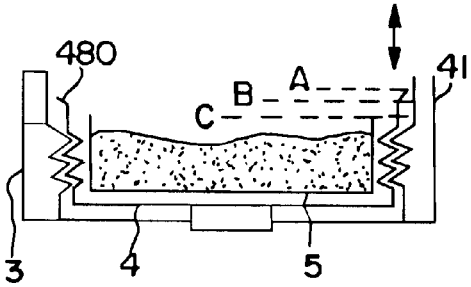
Figure 13B:
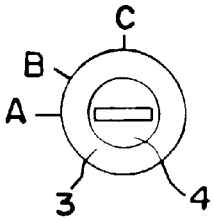

FIGS. 13*a* and 13*b* illustrate the case of a compact for which only the base 3 is shown, which comprises axial movement means and setting means for said axial movement, so as to select a predetermined level of stress. In this case, these means consist of firstly tight co-operation selected to vary with the axial movement, as in the case of FIG. 7*a*, and, secondly, the possibility to select a predetermined axial movement, in this case, by means of screwing/unscrewing the grid 4, possible via an opening in the base of the compact, and therefore the possibility of having several referenced positions (FIG. 13*b*), particularly on the periphery of said opening, which correspond to an axial movement of said lower skirt.

Figure 14:
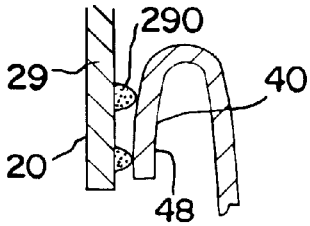

FIG. 14 illustrates a tangential connection between a rigid upper skirt 29 and a flexible lower skirt 48, the rigid upper skirt comprising two rigid sealing ribs 290 formed on the rigid skirt 29.

Figure 15A:
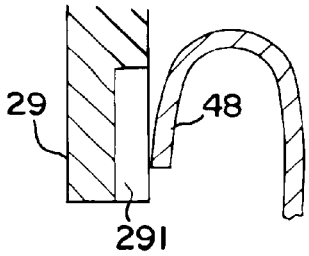
Figure 15B:
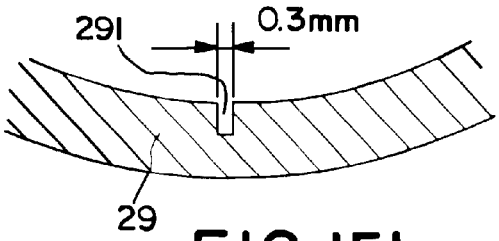
Figure 16A:
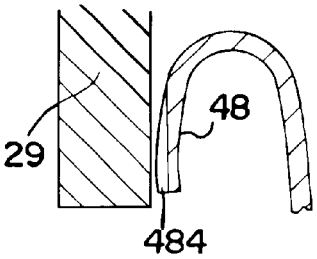
Figure 16B:
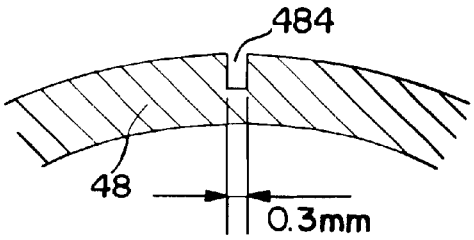

FIGS. 15*a* to 16*b* relate to the presence of a vent in the form of a narrow groove—0.3 mm wide in these figures: groove 291 formed in the rigid upper skirt 29 in FIGS. 15*a* and 15*b*, groove 484 in the flexible lower skirt 48 in FIGS. 16*a* and 16*b*.

DETAILED DESCRIPTION OF THE INVENTION

According to the invention, said flexible skirt 8 may form:

a flexible surface 80, or, a "U" or "V" profile, comprising two components meeting at one end, one of which forms a flexible surface 81, or a "U" or "V" profile, comprising two components meeting at one end, each of which forms a flexible surface 82.

All the embodiments of flexible skirts have been illustrated in the figures, with references starting with "28" in the case of a flexible upper skirt 28, or 280, 281, 282, respectively, and with "48" in the case of a flexible lower skirt 48, or 480, 481, 482, respectively.

There are other possible forms of flexible skirt, for example, as illustrated in FIGS. 5, 5*a* and 10 where the upper and/or lower flexible skirt 8, is a "U" or "V" shaped flexible section 83.

This section 83 may be an upper section 283 secured between said mirror and upper masking means 21, as shown in FIG. 10, or may be a lower section 483 secured between said recipient 5 and upper masking means 41, as shown in FIG. 5.

According to the invention, there are three possible cases for obtaining tight co-operation of the upper skirt 20 and lower skirt 40:

said upper skirt 20 and lower skirt 40 are flexible skirts 8, 80, 81, 82, said tight co-operation being formed between a flexible upper skirt 280, 281, 282, and a flexible lower skirt 480, 481, 482, as illustrated in FIGS. 1*b*, 1*c*, 2*a*, 6*b*, 8, or said upper skirt 20 is a flexible skirt 280, 281, 282, said lower skirt being a rigid skirt 9, 409, as illustrated in FIGS. 4*b*, 10, 11, or said lower skirt 40 is a flexible skirt 480, 481, 482, said skirt being a rigid skirt 9, 209, as illustrated in FIGS. 3, 5, 7, 9*b*.

As illustrated particularly in FIGS. 2 and 6*b*, the section of said mirror 22 may form masking means for said upper skirt 280, 281, 282, 283.

As illustrated in FIGS. 5 and 9*a*, the skirt of said recipient 5 may form masking means for said lower skirt 480, 481, 482, 483.

In both cases, the mirror of the recipient masks the end of the flexible skirt 2820, 4820, particularly when this skirt has a "U" or "V" profile, the end of which is oriented towards the mirror or the recipient.

The compact according to the invention may comprise upper masking means 21 surrounding said upper skirt 20, typically said flexible upper skirt 280, 281, 282, 283, as illustrated in FIGS. 1*a*, 10, 11.

It may comprise lower masking means 41 surrounding said lower skirt 40, typically said flexible lower skirt 480, 481, 482, 483, as illustrated in FIGS. 1*a*, 3, 5, 6*b*, 7, 8, 9*b*.

The masking means may play a clear aesthetic role for cosmetic objects or the packaging of cosmetic products. However, the masking means may play a technical role in the assembly of said compact. They may also form a stop for said "U" or "V" profile flexible skirt 81, 82, 83, such that it remains under continuous tension, as illustrated in FIGS. 2, 7, etc.

According to the invention, one of the skirts 20, 40 or a flexible section 483 may comprise a rib, typically less than 1 mm wide, providing said tangential connection, as illustrated in FIGS. 5, 5*a*, 10. Indeed, it may be advantageous to have a narrow tangential connection, and therefore, with a relatively high pressure, it may be easier to produce tightness with a "cylinder on plane" type than with a wide connection which would be of the "plane on plane" type.

It is also possible to ensure the tightness of the compact with the co-operation of a rigid skirt 29, 49 equipped with one or two rigid ribs 290 which ensure the tight contact with the flexible lower skirt 48, 28, as illustrated in FIG. 14 with the ribs 290 of the upper skirt 29 in contact with the flexible lower skirt 48.

According to a particular embodiment of the invention, one of the upper or lower sealing means may have a degree of freedom in the horizontal plane, either by translation, typically of 1 mm in at least one direction, or by rotation of a few degrees around a fixed rotation centre or axis, the other means being fixed, so as to improve said tight co-operation.

FIG. 12 illustrates the case of a compact in which the upper skirt 20, 280 can rotate a few degrees along an axis parallel with the axis of the hinge 6. This may enable improved distribution of the deflection stress which appears when the compact is closed. Indeed, when closing the compact, it is beneficial that a uniformly distributed deflection stress is induced on the entire perimeter of the skirts intended to co-operate in a tight fashion.

According to another particular embodiment of the invention, said deflection stress may increase with an axial movement. Indeed, it is imaginable that, depending on the value of the angle $\alpha$, an axial movement, i.e. as illustrated in FIG. 1*b*, a movement Z along the vertical direction, could modify the deflection stress: it can be expected to increase insignificantly when the angle $\alpha$ is around 90°, as illustrated in FIG. 1*b*, and that it increases more when the angle $\alpha$ is smaller, as illustrated in FIG. 1*c*.

As illustrated in FIG. 13*b*, this may be beneficial in the case of a compact wherein at least one of the skirts (20, 40) comprises axial movement means and setting means for said axial movement, so as to select a predetermined stress level, particularly in order to obtain a predetermined level of tightness.

According to another embodiment of the invention, not represented by a figure, the compact may comprise several compartments, one of which comprises said recipient and said sealing means. In this case, said masking means may be a plate which, in the compartment comprising said sealing means, is punched to surround said skirt, and which, in another adjacent compartment, forms a tray or a trough to receive additional makeup means.

In addition, the applicant has observed the benefit of having a vent so as to limit, when the compact is closed, positive pressure or a "bicycle pump" effect, and when it is opened, negative pressure or a "suction pad" effect. Indeed, closing a tight compact results in positive pressure inside the compact, while temporary negative pressure is formed when the compact is opened.

This vent, which is typically formed by a recess or a groove between 0.2 and 0.6 mm wide, of a small cross-section ranging between approximately 0.1 and 1 $mm^2$, may be formed on said upper skirt 20, 29 as illustrated in FIGS. 15*a* and 15*b*, or on said lower skirt 40, 48, as illustrated in FIGS. 16 and 16*b*. It enables a leak which restores the pressure equilibrium inside the compact.

Surprisingly, the presence of a vent 291, 484 of a small cross-section, which is therefore intended to facilitate the closure and opening of the compact, does not increase weight losses of cosmetic considerably, probably due to the fact that, once the pressure inside the compact returns to atmospheric pressure, after the compact is closed, the gaseous exchange between the inside of the tight compact and the outside becomes practically non-existent given the small cross-section of the vent.

EXAMPLES OF EMBODIMENTS

The figures represent examples of embodiments of the invention.

The compacts produced were made of PE.

The parts forming the different parts of the compacts were produced by moulding:

the lid 2 with, preferentially, its upper skirt 20 when said skirt could be moulded and therefore removed from the mould simultaneously, otherwise the upper skirt 20 was moulded separately, if applicable, the upper masking means 21, which in some cases could be moulded at the same time as the lid 2, the base 3, the grid 4 with its lower skirt 40, if applicable, the lower masking means 41, possibly moulded at the same time as the base 3, the recipient 5.

Using a known process, these parts were designed to be assembled mechanically by clip-on or snap-on connection, by the co-operation of male and female parts, or by bonding when a mechanical assembly was not possible.

The flexible skirts 8, 28, 48 and the rigid skirts 9, 29, 49 were obtained by adapting the thickness or the type of PE (LD or HD): a skirt 0.5 mm to 1 mm thick is relatively flexible, while a skirt 1 to 2 mm thick is relatively rigid.

Similarly, HDPE is more rigid than LDPE.

Tests were also performed with moulded flexible sections 283, 483, as illustrated in FIGS. 5 and 10.

Tests were also performed with compacts comprising a rigid upper skirt 29 with two sealing ribs 29, as shown in FIG. 14.

Similarly, compacts comprising a vent 291, 484 as illustrated in FIGS. 15*a* to 16*b* were produced.

All the compacts were tested in terms of their tightness by filling them with powder comprising a volatile product, and making samples and performing assays at regular intervals, over a one-year period.

These tests showed the effectiveness of the sealing means described by the invention.

Advantages of the Invention

The invention discloses sealing means offering the advantage of the ability to be adapted to virtually any type of compact.

Through its design, it also allows great manufacturing flexibility in that the tight connection, resulting from the compression between the upper and lower skirt, one of the skirts, which is flexible, being deformed under stress, is produced tangentially. In this way, play in the dimensions of the parts is possible, which reduces the cost of the moulding parts and reduces the number of discarded parts due to non-conforming dimensions.

LIST OF REFERENCES

Compact 1
Cosmetic 10
Lid 2
"Upper" skirt 20
"Upper masking means 21
Mirror 22
Rotation axis 23
Flexible upper skirt 28
Flexible surface 280
single flexible surface U/V 281
rigid part 2810
flexible part 2811
double flexible surface U/V 282
end 2820
flexible section 283
Rigid upper skirt 29
rigid rib 290
vent-groove 291
Base 3
Grid 4
"Lower" skirt 40
"Lower" masking means 41
Flexible lower skirt 48
flexible surface 480
end 4800
single flexible surface U/V 481
rigid part 4810
flexible part 4811
double flexible surface U/V 482
end 4820
flexible section 483
rib 4830
vent-groove 484
Rigid lower skirt 49
Recipient 5
Hinge 6
Clasp 7
Flexible skirt 8
Flexible surface 80
single flexible surface U/V 81
double flexible surface U/V 82
flexible section 83
Rigid skirt 9

What is claimed is:

1. Compact to be filled with cosmetics comprising a lid, generally fitted with a mirror, a hollow base selectively including an intermediate grid attached to said base, a recipient for receiving said cosmetics, a hinge and a clasp, upper sealing means attached to said lid and lower sealing means selectively attached to said base, said grid, or said recipient, said sealing means cooperating when said compact is closed, and further wherein:

a) each of the upper and lower sealing means comprise a vertical skirt of upper and lower skirt sections, b) said cooperation is a tangential connection of said upper and lower skirts, with an angle $\alpha$ between 45° and 90°, such that said skirts are placed under a deflection stress when said compact is closed, c) at least one of said upper or lower skirts is a flexible skirt and has an elasticity or reversible deformability under stress, such that said tangential connection induces said deformation of at least said flexible skirt by reaction along a direction typically perpendicular to the angle $\alpha$, d) masking means, typically rigid and attached to said compact, border, and possibly surrounding, at least one of said skirts, and typically said flexible skirt, selectively over all or part of its height, at a distance from said skirt enabling all or part of said reversible deformation of said flexible skirt, so as to obtain a tight compact with sealing means, which firstly are selectively completely or partially masked and secondly enable great freedom in terms of relative axial positioning and, as a result, standard precision for the parts forming said compact.

2. Compact according to claim 1, wherein said flexible skirt selectively forms:

a flexible surface, or, a "U" or "V" profile, comprising two components meeting at one end, one of which forms a flexible surface, or a "U" or "V" profile, comprising two components meeting at one end, one of which forms a flexible surface.

3. Compact according to claim 1, wherein at least one upper and/or lower flexible skirts selectively is a "U" or "V" shaped flexible section.

4. Compact according to claim 3, wherein said section is an upper section secured between said mirror and upper masking means.

5. Compact according to claim 3, wherein said section is a lower section secured between said recipient and upper masking means.

6. Compact according to claim 1, wherein said upper skirt and lower skirt are flexible skirts, said cooperation being formed between a flexible upper skirt, and a flexible lower skirt.

7. Compact according to claim 1, wherein said upper skirt is a flexible skirt, said lower skirt being a rigid skirt.

8. Compact according to claim 1, wherein said lower skirt is a flexible skirt, said upper skirt being a rigid skirt.

9. Compact according to claim 1, wherein the section of said mirror forms masking means for said upper skirt.

10. Compact according to claim 1, wherein the skirt of said recipient forms masking means for said lower skirt.

11. Compact according to claim 1, comprising upper masking means surrounding said upper skirt.

12. Compact according to claim 1, comprising lower masking means surrounding said lower skirt.

13. Compact according to claim 1, wherein said masking means form a stop for said "U" or "V" profile flexible skirt, such that it remains under continuous tension.

14. Compact according to claim 1, wherein one of the skirts comprises a rib, typically less than 1 mm wide, providing said tangential connection.

15. Compact according to claim 1, wherein one of the upper or lower sealing means may have a degree of freedom in the horizontal plane, either by translation, approximately of 1 mm in at least one direction, or by rotation of a few degrees selectively around a fixed rotation center or axis, the other means being fixed, so as to improve said cooperation.

16. Compact according to claim 1, wherein the angle a of said tangential connection is selected such that said deflection stress increases with an axial movement of said upper and lower skirts.

17. Compact according to claim 16, wherein at least one of the skirts comprises axial movement means and setting means for said axial movement, so as to select a predetermined level of stress.

18. Compact according to any of claims 1 to 17 comprising several compartments, one of which comprises said recipient and said sealing means.

19. Compact according to claim 18, wherein said masking means consist of a plate which, in the compartment comprising said sealing means, is punched to surround said skirt, and which, in another adjacent compartment, forms a tray or a trough to receive additional makeup means.

20. Compact according to claim 1, wherein one of the upper or lower skirts selectively comprises one or two rigid ribs which form said tangential connection with the other skirt.

21. Compact according to claim 1, wherein one of the upper or lower skirts comprises a groove between 0.2 and 0.6 mm wide, forming a vent, so as to limit positive pressure in the compact when it is closed, and negative pressure in the compact when it is opened.

* * * * *

UNITED STATES PATENT AND TRADEMARK OFFICE

CERTIFICATE OF CORRECTION

PATENT NO. : 6,345,628 B2
DATED : February 12, 2002
INVENTOR(S) : Robert Petit

It is certified that error appears in the above-identified patent and that said Letters Patent is hereby corrected as shown below:

Title page,
Item [57], ABSTRACT, insert
-- The compact comprises a lid, a hollow base typically using an intermediate grid, a recipient, a hinge and a clasp. Upper sealing means are attached to the lid and lower sealing means are attached to the base, the sealing means cooperating when the compact is closed. Each of the upper and lower sealing means include a vertical skirt. Tight cooperation is achieved by a tangential connection of the upper and lower vertical skirts, with an angle α between 45 degrees and 90 degrees. --

Signed and Sealed this

Twenty-third Day of December, 2003

JAMES E. ROGAN
*Director of the United States Patent and Trademark Office*